US005227572A

United States Patent [19]

Cusack et al.

[11] Patent Number: 5,227,572

[45] Date of Patent: Jul. 13, 1993

[54] TITANIUM REED FOR MUSICAL INSTRUMENTS

[76] Inventors: John F. Cusack, 169 E. Rienstra St., Chula Vista; Gerald H. Finch, 1202 Caminito Quixote, San Diego, both of Calif. 92154

[21] Appl. No.: 756,794

[22] Filed: Sep. 9, 1991

[51] Int. Cl.[5] ..... G10D 9/02

[52] U.S. Cl. ..... 84/383 A; 84/452 R

[58] Field of Search ..... 84/383 A, 452 R; 29/421.1, 557, 558; 72/189, 198

[56] References Cited

U.S. PATENT DOCUMENTS

| | | | |
|---|---|---|---|
| 1,133,868 | 3/1915 | Lynn | 84/383 A |
| 1,616,748 | 2/1927 | Horton | 84/383 A |
| 2,318,515 | 5/1943 | Nemcek | 84/383 A |
| 2,456,298 | 12/1948 | Miller | 84/383 A |
| 3,636,810 | 1/1972 | Reefman | 84/457 |
| 4,979,420 | 12/1990 | Cusack et al. | 84/383 A |

*Primary Examiner*—Michael L. Gellner
*Assistant Examiner*—Cassandra C. Spyron
*Attorney, Agent, or Firm*—Brown, Martin, Haller & McClain

[57] ABSTRACT

A titanium reed is formed by cutting a hardened sheet of high-grade titanium into a strip where length and width are determined by the standard sizes and lays of mouthpieces of various musical instruments in the woodwind family. The titanium sheet stock from which the strip is cut may be hardened prior to cutting, or hardening processes may be preformed on the cut strips after shaping has occurred. Where the sheet stock is prehardened, the techniques involve heating to a high temperature and thinning out a portion of the sheet to form a taper. Where hardening is required after the strip is cut and formed, heat treatment is applied to achieve a strength in the titanium corresponding to the desired tone of the reed. In all processes, material is removed from the bottom of the reed from the approximate center toward the tongue end to relieve stress in the metal at the tongue end. A second material removal step is performed at the center of the tongue end causing the metal to bow downward, creating a concave depression.

10 Claims, 1 Drawing Sheet

TITANIUM REED FOR MUSICAL INSTRUMENTS

FIELD OF THE INVENTION

The present invention relates to metal reeds for wind instruments and a method for making such reeds, and more specifically, to titanium reeds.

BACKGROUND OF THE INVENTION

Most woodwind instruments are played by blowing air past one or more reeds in the mouthpiece which then vibrate, producing a musical tone. The reed for these instruments has historically been made of cane, which is of sufficient thickness to produce the desired vibratory response, but which is also very delicate and subject to breaks, splits and molecular breakdown due to vibration and from the body acids to which it is subjected. An additional drawback to the cane reed is that disinfecting the reed is difficult, due both to its porosity and the fact that it must be kept moist to avoid cracking. On the other hand, an overly-moistened reed loses elasticity and, therefore, does not vibrate as needed to produce the desired tones. Finally, the delicate nature of reeds has prevented blind and vision-impaired music students from learning to play most woodwinds. Reeds require almost constant attention to maintain. For a blind student, inserting, checking and adjusting the reed means touching and usually breaking it.

Many attempts have been made to form a reed from plastic, plastic-impregnated or fibrous-type material. These synthetic models did not provide the same vibratory response as cane reeds.

Several early patents disclosed methods of making metal reeds for wind instruments which involved hammering the metal to thin and densify the tongue end of the reed (U.S Pat. No. 1,133,868); or to grind or roll the tongue end to make it thinner (U.S. Pat. No. 1,616,748). A third patent describes cutting longitudinal grooves in the tongue to make the reed more elastic but still rigid (U.S. Pat. No. 1,667,836). None of the reeds described in these became commercially successful, however, and cane remains the favored reed for all woodwinds. The metal reeds did not have the fibratory response of cane due to the ductal nature of the metal, so the instruments could not produce the desired tonal quality.

In U.S. Pat. No. 4,979,420 issued Dec. 25, 1990, the present inventors disclosed a stainless steel reed of sufficient stiffness to provide the necessary vibratory response for musical instruments. This stainless steel reed has been met with enthusiastic acceptance. It has been found that the time consumed in the friction extraction process needed to manufacture the stainless steel reed can be considerably shortened by chemical milling of the sheet stock to remove a portion of the metal. Further, the excessive heat formed by this high-speed friction is avoided. The disadvantage of this process is that the chemicals required for "chem-milling", hydrochloric acid, sulfuric acid and nitric acid, are very caustic, and present a significant handling and disposal problem in view of increasingly-stringent environmental restrictions, resulting in such a process being relatively expensive.

It is known that there are other materials, titanium in particular, which can be processed in a manner similar to stainless steel, but which do not require the same hazardous chemicals for chem-milling, so the process itself becomes less costly. Titanium, like stainless steel, is also known for its inert quality, making it useful for medical implants such as artificial joints. Therefore, it would provide the needed resistance to breakdown as a result of exposure to body acids. One drawback is that titanium is relatively brittle and would not, in an untreated state, possess sufficient flexibility to provide the vibratory response needed for use as a reed.

It would be desirable to have a reed and a process for making such a reed which possesses the advantages of a stainless steel reed but is less expensive and hazardous to manufacture. It is to such a reed and a process that the present invention is directed.

SUMMARY OF THE INVENTION

It is an advantage of the present invention to provide a metal reed which gives the desired vibratory response for use with wind instruments but which does not require the same costly and environmentally-hazardous processing as does a stainless steel reed.

It is a further advantage of the present invention to provide a method for forming such a titanium reed which is more economical than a comparable stainless steel reed.

In an exemplary embodiment, a titanium reed is formed by cutting a hardened sheet of high-grade titanium into a strip where length and width are determined by the standard sizes and lays of mouthpieces of various musical instruments in the woodwind family. The titanium sheet stock from which the strip is cut may be hardened prior to cutting, or hardening processes may be performed on the cut strips after shaping has occurred, or a combination of the before and after processes may be used.

In processes where the sheet stock is prehardened, the techniques involve heating to a high temperature and thinning out a portion of the sheet to form a taper from the edges in toward the center to create a shallow "V", or from the center to the edges creating an inverted "V". The heating process at least partially hardens the titanium. In some processes, additional heat treatment may be necessary in a subsequent step. The sheet is then cut at the center of the "V" to create two tapered sections. The strips are cut from the tapered sections with the tongue of the reed corresponding to the thinned portion from the center of the "V". A curved radius is formed at the tongue end of the strip to match the curvature of the leading edge of the mouthpiece.

For processes where hardening is required after the strip is cut and formed, heat treatment within the range of 1300° to 1700° F. is applied to achieve a strength in the titanium corresponding to the desired tone of the reed.

In all processes, material is removed from the bottom of the reed from the approximate center toward the tongue end, usually by friction extraction, to culture the reed, relieving stress in the metal at the tongue end. Friction extraction processes include grinding, cutting and electro-discharge machining (EDM). The process of friction extraction produces heat and stress which harden the material remaining in the reed. Then, a second friction extraction step is performed at the center of the tongue end. The removal of material induces stress, causing the metal to bow downward, creating a concave depression. Material remaining around the edge of the depression acts as support for the thin center section and provides springiness to allow pitch control by varying pressure on the reed.

During the heat treatment, a set crimp (bend) may be created in the metal in the approximate tangent to the lay of the mouthpiece for which the reed is intended, especially if the reed arcs toward the mouthpiece. By this procedure, the titanium is additionally stress-hardened on the contact surface between the reed and the lay of the mouthpiece. The desired vibratory response of the reed determines the amount of stress to be placed on the set crimp.

BRIEF DESCRIPTION OF THE DRAWINGS

Understanding of the present invention will be facilitated by consideration of the following detailed description of a preferred embodiment of the present invention, taken in conjunction with the accompanying drawings, in which like reference numerals refer to like parts and in which.

DETAILED DESCRIPTION OF THE PREFERRED EMBODIMENTS

Figure 1:
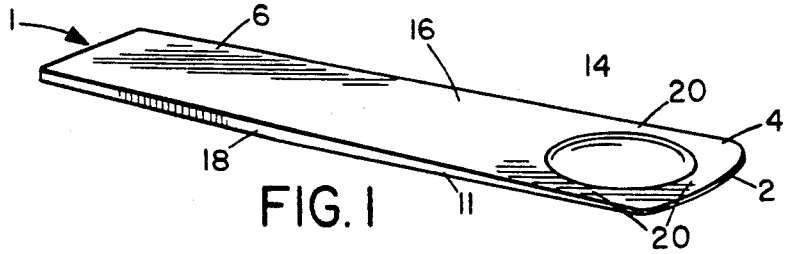
FIG. 1 is a perspective view of the titanium reed.
Figure 2:
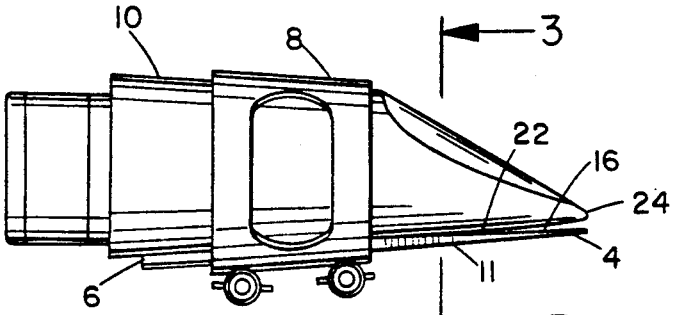
FIG. 2 is a side view of a reed attached to a mouthpiece.
Figure 3:
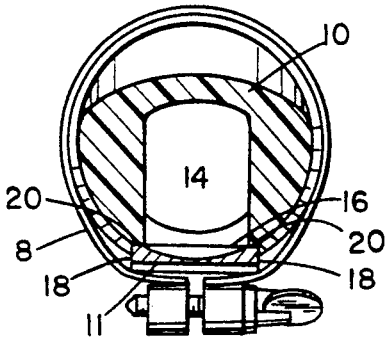
FIG. 3 is a cross-sectional drawn on line 3—3.
Figure 5:
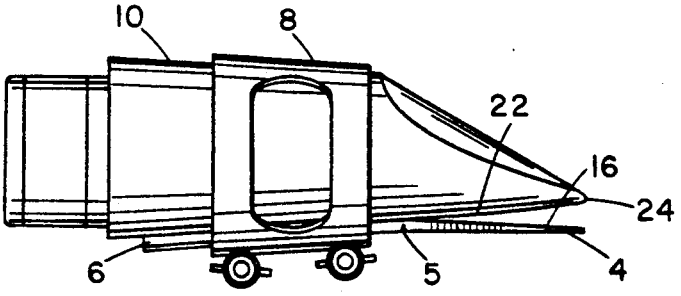
FIG. 5 is a side view of a reed with an optional set cramp attached to a mouthpiece.

Referring to FIGS. 1 and 2, the reed 1 is formed from a strip of titanium. The edge 2 of the strip is rounded to follow the contour of the mouthpiece 10. The base 6 of the reed 1 is held stationary, clamped to the mouthpiece 10 by a ligature 8 or similar clamp. An optional set crimp 5, shown exaggerated in FIG. 5, may be created at the approximate tangent to the lay 22 of the mouthpiece to cause the tongue end of the reed 1 to bend slightly away from the mouthpiece 10 if the reed arcs slightly toward the mouthpiece. The tongue 4 is formed by one or more of the below-described methods so that it tapers beginning at the approximate center 12 of the reed toward the edge 2 to form a thin vibrating tip. The taper is further enhanced by removing material from the bottom 11. Additional material is removed from the central portions of the lower surface 11 of the reed (corresponding to depression 14) so that, due to the stress induced at that location, a dimple forms which will reverberate when played.

Several different methods may be used to form the titanium reed, some of which require processing of the sheet stock before cutting the strips from which the reed will be made, while others begin the process by cutting strips and then performing the required steps.

The first method to be described is cutting blanks from the titanium sheet stock according to the standard sizes of the various musical instrument mouthpieces. The preferred grade of titanium is "customer pure". The edge 2 of the strip is rounded to conform to the curvature of the leading edge of the appropriate mouthpiece.

Figure 4:
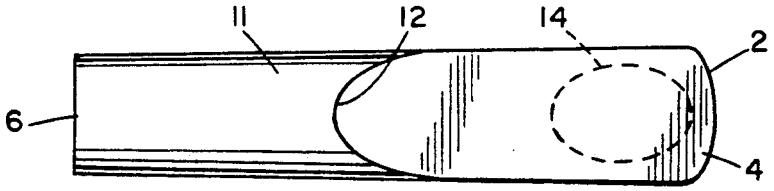
FIG. 4 is a plan view of the lower surface of the reed.

The taper which permits vibration of the reed is formed by friction extraction of material from the lower surface 11 of the strip. Friction extraction processes include grinding, cutting and electro-discharge machining (EDM), each process providing a means for material removal by subjecting the material to friction. The taper begins at the approximate lengthwise center 12 of the strip and continues to the edge 2, as in FIG. 4. Removal of the material from the lower surface 11 causes the inside wall of the upper surface 16 to be exposed. The process of friction extraction on the inside wall further hardens the upper surface by heat and stress-induced molecular change, enhancing the vibratory response of the reed. The finished reed is heat treated at a temperature between 1300° and 1700° F., the temperature being selected by the desired strength to set the sound (tone).

In some cases it may be desirable during the heat treatment, to bend the reed 1 laterally at the point at which the reed 1 will be tangent to the lay 22 of the mouthpiece to crease set crimp 5. This is shown exaggerated in FIG. 2. This causes a hardening of the titanium at the crimp 5 and creates a greater distance between the tongue 4 and the leading edge 24 of the mouthpiece to permit greater vibration of the tongue 4. The set crimp 5 may be necessary if any bowing has occurred during processing of the reed which causes the tongue 4 to arc toward the mouthpiece. Friction extraction is then used to remove additional material from the bottom of the reed to create a concave depression 14. Due to the stress and heat built up during this extraction process the thinned metal bows downward. Material remaining at the edge of the depression 14 are lateral supports 20, providing springiness to control pitch by varying pressure applied to the tongue 4.

It is possible to achieve the desired hardness and stress relief by friction extraction alone without additional heat treatment, because a long period of friction extraction generates a substantial amount of heat. This procedure is relatively costly, however, because it takes a great deal of time to remove all of the material required to make the taper and achieve the level of heat required for culturing and stress relief.

The remaining methods of formation of the titanium reed involve treatment of the titanium sheet stock ("customer pure") prior to cutting the blanks of which the reeds will be made. In the first such method, sheet stock is heated at its center to approximately 1700° F. while being clamped at opposing ends, then hydraulically stretched by pulling the clamps in opposite directions. This stretch produces a taper which is thinnest at the center of the sheet stock, where it is being heated, and thicker at the edges. The sheet stock is then cut down the center at the thinnest point, i.e., the lowest point in a "V", and blanks are cut from which the tongue end and fitted sizes are die cut or laser cut to suit various mouthpieces, where the tongue end corresponds to the thinned portion.

Stress is relieved by friction extraction of material from the bottom of the reed, as above, and concave depression 14 is created by additional friction extraction of material from the bottom 11 of the reed at the center of the tongue. The finished reeds are heat treated to the desired strength to set the tone, the temperature for heat treatment being determined by the tone desired.

As above, during heat treatment a crimp 5 may be placed in the metal laterally across the reed at the approximate tangent to the lay of the mouthpiece to which the reed is to be fitted. Again, this step is not necessary, however this crimping stress hardens the titanium reed at the contact surface with the lay of the mouthpiece. The amount of stress placed on the crimp or bend will control the vibratory response of the reed, with more stress providing a higher number of vibrations per second in the reed during play.

A second method of treating the titanium sheet stock is known as "super plastic forming" (SPF). In SPF, the titanium sheet stock is clamped into position above a mold chamber and below a heated element chamber. In order to form the titanium reed of the present invention, the mold chamber is in the shape of a "V" cavity. The upper heated element chamber has an electrically-heated silica block. The sheet stock is heated by the heating element so that, at approximately 1700° F., the titanium becomes plastic in consistency and, therefore, pliable. Argon gas is then injected into the upper chamber at approximately 300 p.s.i. blowing down the pliable titanium into the mold surface. The "V" cavity mold will cause two tapered walls to be thinned out to a near "blowout", i.e., to an extremely thin sheet (on the order of 1/2000$^{th}$). At the bottom of the "V" the two walls will be divided and cut into blanks from which the reeds will be formed, the thinned portion corresponding to the tongue. Using this procedure, heat treating for hardening in the final operation is not needed, so that all that remains is to cut the reeds into the desired shapes and sizes for use with specific instruments. Friction extraction is performed for stress relief as above. Concave depression 14 is formed as described previously.

The third method of treatment of sheet stock is chemical milling or "chem-milling". Chem-milling of titanium is accomplished by exposing areas of the metal to a 9:1 mixture of water and 70% HF (hydrofluoric acid) plus a wetting agent so that the desired areas are decomposed to create a thinner sheet. At an etch rate of 1 mil per minute, a 30 second etch of the tongue 4 removes one-half mil from each side (top and bottom) of the tongue 4. This method is preferred for treatment of titanium as opposed to stainless steel, because of the dangerous and difficult-to-dispose-of chemicals required for chemical milling of stainless steel. With chem-milling of titanium, safety standards are eased because HF is more easily neutralized so that disposal of the chemicals is not as much of a problem. The decomposition of the metal is used to form the desired taper, after which the blanks are cut and the reed is formed, including concave depression 14. After final formation of the reed, it is heat treated to 1700° F. for hardening.

A final possible method of forming the titanium reed is by iso-thermal molding. The titanium is pre-cut into bands (larger than the reed blanks) which are fed through two opposing heated rollers (these rollers are made of molybdenum and have electrodes in their interiors to provide heat). The rollers are pressed together at high pressure so that by heating the titanium while it is fed between the rollers, the metal is "stretched" and hardened. The metal will be thinnest at the ends of the bands. By cutting the band at its center the ends of the bands will correspond to the tongue end.

The curvature of the end 2 is formed and friction extraction, as above, is used for stress relief and formation of depression 14.

In all methods, the heat treatment described is variable depending on the stiffness (hardness) desired. For greater hardness which will provide brighter sound, the temperature of heat treatment should be increased within the range identified. Generally it is desirable to approach or exceed the crystalline transition temperature of titanium, approximately 1625° F.

The titanium reeds of the present invention have sufficient stiffness to simulate the vibratory response of cane reeds, thus providing the same tonal quality. The titanium is inert to body chemistry, easy to clean and disinfect, significantly less fragile than cane reeds, and less expensive to manufacture than the stainless steel reed of the '420 patent. An additional advantage of the titanium reed is that it, like its stainless steel counterpart, may be handled without risk of damage, so that visually-impaired musicians and music students can finally learn to play instruments requiring reeds.

It will be evident that there are additional embodiments which are not illustrated above but which are clearly within the scope and spirit of the present invention. The above description and drawings are therefore intended to be exemplary only and the scope of the invention is to be limited solely by the appended claims.

We claim:

1. A method of producing a metal reed for a wind instrument having a mouthpiece which comprises:

cutting a narrow strip of titanium having an upper surface, a lower surface, a base end and a tongue end;

forming a curved radius in said tongue end, said curved radius being shaped to match said mouthpiece;

forming a taper in said tongue end beginning at an approximate lengthwise center of said strip and progressing toward said curved radius;

forming a generally concave depression in said tongue end by friction extraction; and heat treating said narrow strip to harden said titanium to a desired hardness.

2. A method as in claim 1 wherein the step of forming a taper in said tongue end comprises friction extraction of material from said lower surface.

3. A method as in claim 1 wherein the step of forming a taper in said tongue end comprises chemical milling.

4. A method as in claim 1 further comprising crimping said narrow strip laterally across said strip to enhance vibratory response.

5. A method of producing a metal reed for a wind instrument having a mouthpiece which comprises:

exposing sheet stock of titanium having a thickness to an elevated temperature and a pressure whereby a taper is formed in the thickness of said sheet stock, said taper having a thickest portion and a thinnest portion;

cutting a narrow strip of titanium from said sheet stock, said narrow strip having a base end and a tongue end where said tongue end corresponds to the thinnest portion of said taper;

forming a curved radius in said tongue end, said curved radius being shaped to match said mouthpiece; and forming a generally concave depression in said tongue end by friction extraction.

6. A method as in claim 5 wherein the step of exposing sheet stock of titanium to an elevated temperature and a pressure comprises clamping opposing ends of said sheet stock and pulling said ends in opposite directions while heating said sheet stock.

7. A method as in claim 5 further comprising heat treating said strip after it is formed, said heat treatment being determined by a desired tonal quality of said reed.

8. A method as in claim 5 wherein the step of exposing sheet stock of titanium to an elevated temperature and pressure comprises heating said sheet stock to a state of plasticity and applying gaseous pressure to one side of said sheet stock to force said sheet stock into a mold to create said taper.

9. A method as in claim 5 wherein the step of exposing sheet stock of titanium to an elevated temperature and pressure comprises cutting bands from said sheet stock and press rolling said bands between a pair of heated rollers to create said taper.

10. A method as in claim 5 further comprising crimping said narrow strip laterally across said narrow strip to enhance vibratory response.

* * * * *